US005701851A

United States Patent [19]

Nakano et al.

[11] Patent Number: 5,701,851

[45] Date of Patent: Dec. 30, 1997

[54] COOLING SYSTEM FOR SPARK-IGNITION TWO-CYCLE ENGINE

[75] Inventors: Yasuhiko Nakano; Yoichi Ishibashi, both of Saitama, Japan

[73] Assignee: Honda Giken Kogyo Kabushiki Kaisha, Tokyo, Japan

[21] Appl. No.: 747,820

[22] Filed: Nov. 13, 1996

Related U.S. Application Data

[63] Continuation of Ser. No. 348,894, Nov. 25, 1994, abandoned.

[30] Foreign Application Priority Data

Nov. 27, 1993 [JP] Japan ..... 5-321035

[51] Int. Cl.[6] ..... F01P 3/20

[52] U.S. Cl. ..... 123/41.1; 123/41.29

[58] Field of Search ..... 123/41.1, 41.29, 123/41.08

[56] References Cited

U.S. PATENT DOCUMENTS

| | | | |
|---|---|---|---|
| 1,774,881 | 9/1930 | Fry | 123/41.09 |
| 2,216,802 | 10/1940 | Baster | 123/41.29 |
| 2,445,684 | 7/1948 | Mallory | 123/41.08 |
| 3,444,845 | 5/1969 | Scheiterlein | 123/41.29 |
| 4,212,270 | 7/1980 | Nakanishi et al. | 123/41.1 |
| 4,726,324 | 2/1988 | Itakura | 123/41.1 |
| 4,726,325 | 2/1988 | Itakura | 123/41.1 |
| 5,337,704 | 8/1994 | Roth | 123/41.1 |

FOREIGN PATENT DOCUMENTS

| | | | |
|---|---|---|---|
| 3633411 | 1/1986 | Germany . | |
| 4214850 | 11/1993 | Germany . | |
| 53123738 | 10/1976 | Japan . | |
| 56-38766 | 9/1981 | Japan . | |
| 56-54336 | 12/1981 | Japan . | |
| 57-93621 | 6/1982 | Japan | 123/41.08 |
| 61-001817 | 1/1986 | Japan . | |
| 62-23523 | 1/1987 | Japan . | |
| 63-088215 | 4/1988 | Japan . | |
| 3-33426 | 2/1991 | Japan . | |
| 2247745 | 11/1992 | United Kingdom . | |

*Primary Examiner*—Noah P. Kamen

*Attorney, Agent, or Firm*—Birch, Stewart, Kolasch & Birch, LLP

[57] ABSTRACT

In a spark-ignition two-cycle engine, the inlet end of a cylinder cooling water passage is connected to the discharge port of a cooling water pump by a cooling water pipe. The inlet end of a cylinder head cooling water passage is connected to the discharge port of a cooling water pump by a cooling water pipe. The outlet end of the cylinder cooling water passage is connected through a thermostat to the upper end of a cylinder cooling radiator, and the outlet end of the cylinder head cooling water passage is connected through a three-way valve to the upper end of a cylinder head cooling radiator and a pipe fitting. Upon the increase of the temperature of the cooling water for cooling the cylinder head to a predetermined temperature, a CPU provides a control signal to a servomotor to close a port of the three-way valve connected to the pipe fitting and to open a port of the three-way valve connected to the cylinder head cooling radiator.

10 Claims, 10 Drawing Sheets

COOLING SYSTEM FOR SPARK-IGNITION TWO-CYCLE ENGINE

This application is a continuation of application Ser. No. 08/348,894 filed on Nov. 25, 1994, now abandoned.

BACKGROUND OF THE INVENTION

1. Field of the Invention

The present invention relates to a cooling system for a spark-ignition two-cycle engine that makes a fresh charge charged into its combustion chamber self-ignite at least in a low-load operation mode during a cold condition of the engine such as at the start of operation of the two-cycle engine.

2. Description of Background Art

A conventional automotive spark-ignition two-cycle engine to be mounted on a motorcycle has a cylinder provided with an exhaust port and a scavenging port disposed so as to be opened and closed by a piston fitted in the cylinder bore thereof. New charge compressed in a crank chamber is supplied through the scavenging port into the cylinder bore while the exhaust gas is discharged through the exhaust port, and the fresh charge compressed in the combustion chamber is ignited by an ignition plug. Since some quantity of fresh charge must be supplied into the cylinder during idling operation, a restrictor valve provided on an intake passage must be opened at a certain opening, for example, at an opening equal to 10% or more of the full opening.

When a large exhaust port is formed in the cylinder of such a conventional spark-ignition two-cycle engine to increase the output and efficiency of the spark-ignition two-cycle engine in a high-speed high-load operation mode, the blow-by and unstable combustion of the fresh charge occur while the spark-ignition two-cycle engine is operating in a low-load operation mode, which increases the unburnt hydrocarbon concentration of the exhaust gas and fuel consumption.

To solve such problems, the applicants of the present patent application developed a spark-ignition two-cycle engine and proposed the same in Japanese Patent Application No. 5-187488. This previously proposed spark-ignition two-cycle engine regulates the valve opening ratio of an exhaust control valve according to the engine speed and the opening of the throttle valve to regulate the pressure in the cylinder at an appropriate pressure in a state where the exhaust port is closed by the piston at least in a low-load operation mode to make the fresh charge supplied into the combustion chamber self-ignite at an ignition time suitable for the operation of the engine.

Combustion initiated in an activated thermal atmosphere by positively controlling ignition timing suitable for the operation of the engine will be called "AR combustion" hereinafter.

The spark-ignition two-cycle engine capable of causing AR combustion in such a low-load operation mode activates the fresh charge by the thermal energy of the combustion gas. Therefore, it is difficult to cause AR combustion at the start of the engine because the temperature of the wall of the combustion chamber is low.

Particularly, a conventional water-cooled two-cycle engine 01 is provided on a cooling water passage with a thermostat 02 that allows cooling water to flow at a low flow rate even when the temperature of the engine is low. A cooling water pump 03 is directly coupled with the crankshaft, not shown, and a water jacket forms cooling water passages around a wall 04 defining a cylinder bore and a wall 05 defining a combustion chamber. Therefore, the cooling water flows through the cooling water passage around the wall of the combustion chamber to cool the wall of the combustion chamber even immediately after the engine has been started and, consequently, increase in the temperature of the wall of the combustion chamber is suppressed and hence it is difficult to start AR combustion.

OBJECTS AND SUMMARY OF THE INVENTION

The present invention relates to improvements in a spark-ignition two-cycle engine to overcome such disadvantages and it is therefore an object of the present invention to provide a cooling system for a spark-ignition two-cycle engine that causes a fresh charge charged into its combustion chamber to self-ignite at least in a lowload operation mode, the cooling system comprising a cylinder cooling system, and a cylinder head cooling system combined in parallel with the cylinder cooling system and having a cooling capacity lower than that of the cylinder cooling system at the start of the two-cycle engine, wherein a cooling water temperature regulating means for increasing the cooling capacity of the cylinder head cooling system after the temperature of the cooling water circulating through the cylinder head cooling system has reached a predetermined temperature.

According to the present invention, the temperature of the cooling water circulating through the cylinder head cooling system rises at a rate far higher than the temperature of the cooling water circulating through the cylinder cooling system immediately after the start of the two-cycle engine. Therefore, the temperature of the wall of the combustion chamber reaches a temperature at which AR combustion is possible in a short period of time, so that the unburnt hydrocarbon concentration of the exhaust gas is reduced and fuel consumption is improved.

Upon the increase of the temperature of the cooling water circulating through the cylinder head cooling system to a predetermined temperature, the cooling water temperature regulating means operates to increase the cooling capacity of the cylinder head cooling system to maintain the wall of the combustion chamber at an appropriate temperature even during high-load operation to ensure the smooth operation of the spark-ignition two-cycle engine.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 4 is a side view of the spark-ignition two-cycle engine of FIG. 1 as viewed from a side opposite the side from which FIG. 1 is viewed;

PREFERRED EMBODIMENTS OF THE INVENTION

Figure 1:
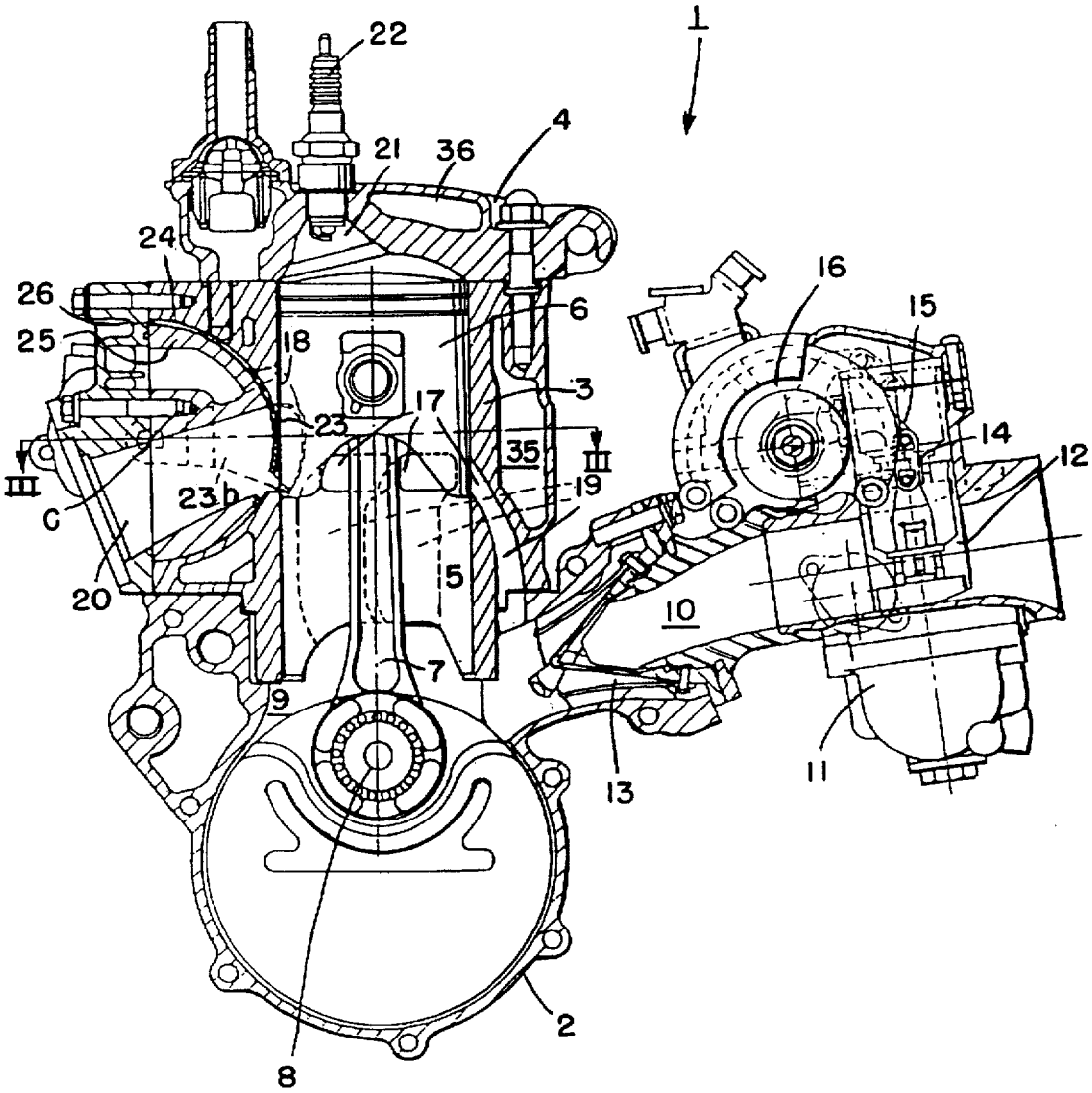
FIG. 1 is a longitudinal sectional view of the cylinder unit of a spark-ignition two-cycle engine provided with a cooling system in a first embodiment according to the present invention.

A cooling system in a preferred embodiment according to the present invention will be described hereinafter with reference to FIGS. 1 to 5.

A spark-ignition two-cycle engine 1 incorporating the present invention and provided with a restrictor valve controller is mounted on a motorcycle, not shown. The spark-ignition two-cycle engine 1 has a crankcase 2, a cylinder block 3 fixedly mounted on the crankcase 2, and a cylinder head 4 fixed to the upper end of the cylinder block 3.

A piston 6 axially slidably fitted in a cylinder bore 5 formed in the cylinder block 3 is connected to a crank 8 by a connecting rod 7. As the piston moves axially in the cylinder bore 5, the crank 8 is driven for rotation.

An intake pipe 10 is connected to a crank chamber 9 formed in the crankcase 2, and a carburetor 11 and a reed valve 13 are arranged one after the other on the intake pipe 10. The piston type throttle valve 12 of the carburetor 11 is connected through a rod 14 and a lever 15 to a throttle drum 16 which in turn is connected to a throttle grip, not shown, by a wire, not shown. When the throttle grip is turned in one direction the throttle valve 12 is raised to increase throttle opening.

The intake pipe 10 is connected to the crank chamber 9 of the crankcase 2. A scavenging port 17 and an exhaust port 18 are formed in the wall of the cylinder bore 5. The scavenging port 17 communicates with the crank chamber 9 by means of a scavenging passage 19, and the exhaust port 18 is connected to an exhaust passage 20.

A recess is formed in the cylinder head defining a combustion chamber 21 over the cylinder bore 5 on the side of the exhaust port 18, and a spark plug 22 is placed in the recess. An air-fuel mixture i.e., a fresh charge, is taken through the reed valve 13 into the crank chamber 9 in which a negative pressure prevails while the piston 6 is in an up stroke. The fresh charge is compressed in the crank chamber 9 while the piston 6 is in a down stroke, and the compressed fresh charge is caused to flow into the combustion chamber 21 when the scavenging port 17 is opened. Then, part of the combustion gas is discharged from the combustion chamber 21 through the scavenging port 17 into the scavenging passage 19. As the piston 6 moves upward, first the scavenging port 17 is closed, then the exhaust port 18 is closed, and then the fresh charge is compressed in the combustion chamber 21. Upon the arrival of the piston 6 at a position near the top dead center, the fresh charge is ignited by the spark plug 22 or is caused to self-ignite by the thermal energy of the residual combustion gas.

Figure 2:
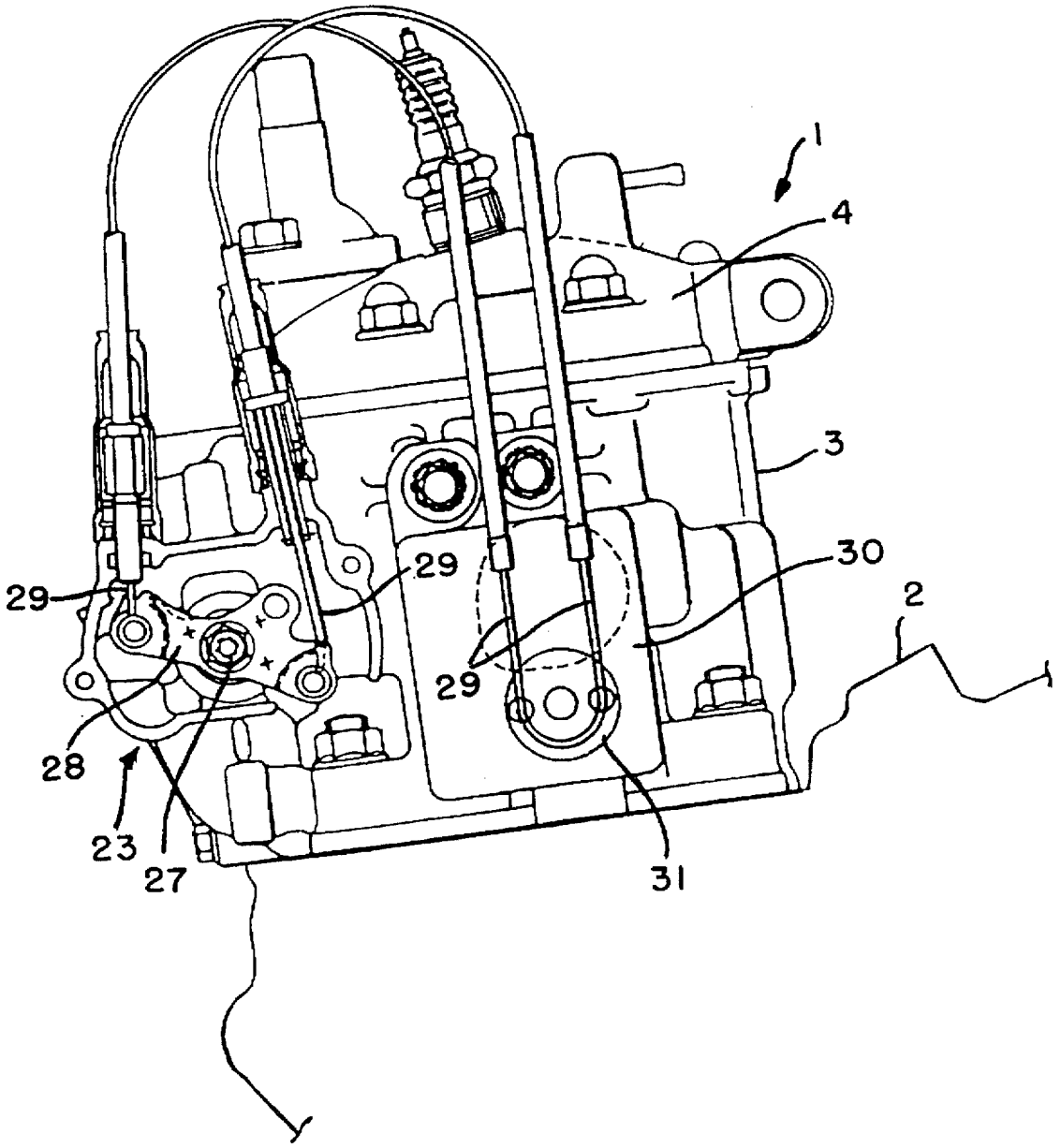
FIG. 2 is a side view of the cylinder unit of FIG. 1.
Figure 3:
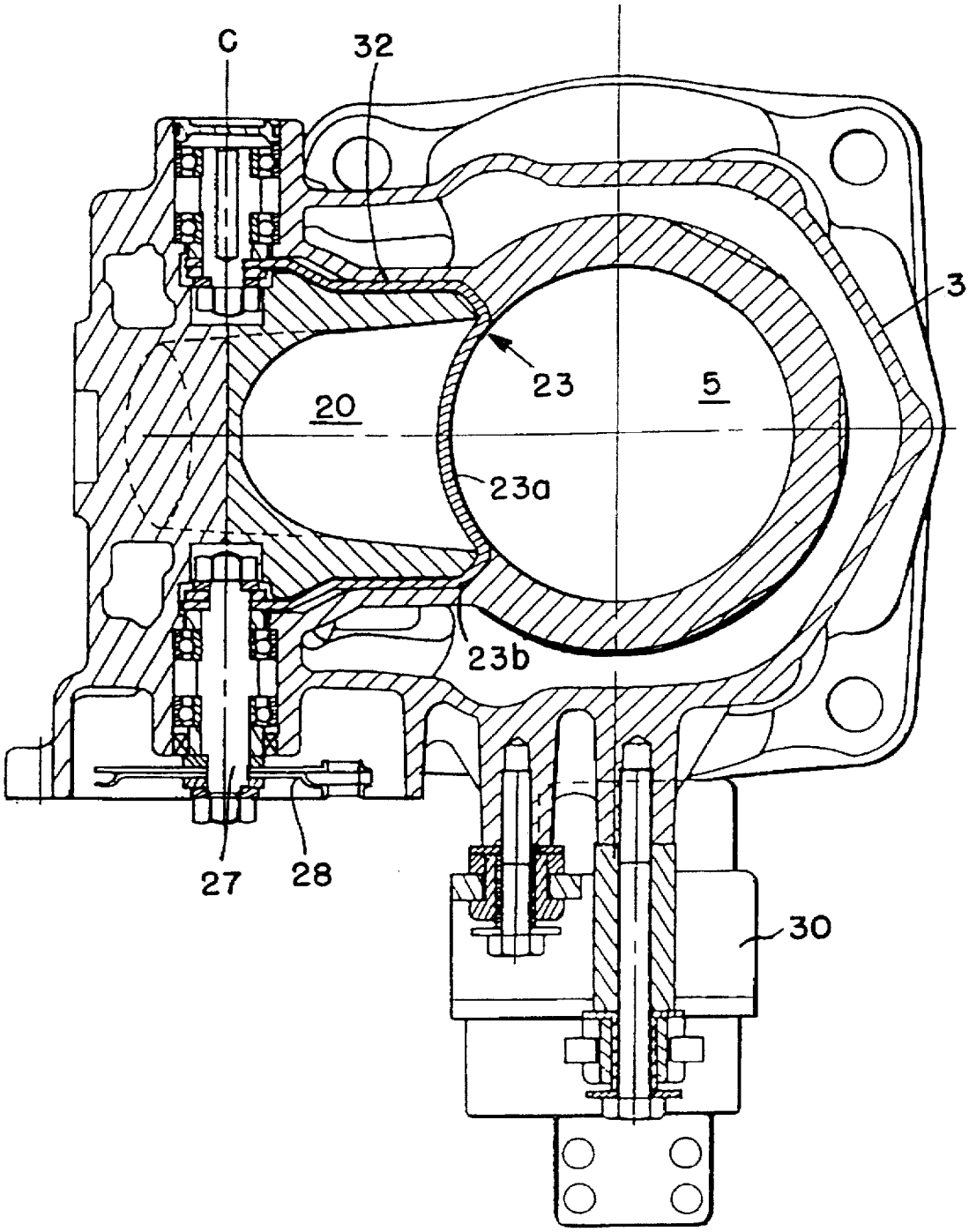
FIG. 3 is a transverse sectional plan view taken on line III—III in FIG. 1.

An exhaust control valve 23 is disposed near the exhaust port 18. The exhaust control valve 23 is fitted in a space 26 of a uniform width formed between a recess 24 formed in the cylinder block having a longitudinal cross section having the shape of a circular arc and an exhaust passage member 25 having a longitudinal cross section substantially the same as that of the recess 24, and is pivotally supported for turning in a vertical plane. As shown in FIG. 2, a driving lever 28 is fixedly mounted on a driving shaft 27 fixed to the exhaust control valve 23, and the driving lever 28 is connected to a pulley 31 fixed to the output shaft of an exhaust control servomotor 30 by a driving cable 29. The exhaust control servomotor 30 drives the exhaust control valve 23 for vertical turning to set the exhaust control valve 23 at an exhaust opening ratio $\theta_e$ in the range of 0 to 100%.

The side arms 23*b* of the exhaust control valve 23 having a U-shaped horizontal cross section are fitted in spaces 32 extending on the opposite sides of the exhaust passage 20, so that only the circular valve portion 23*a* of the exhaust control valve 23 for closing the exhaust port 18 is exposed to the exhaust gas. The side arms 23*b* do not adversely interfere with the flow of the exhaust gas at all.

Figure 4:
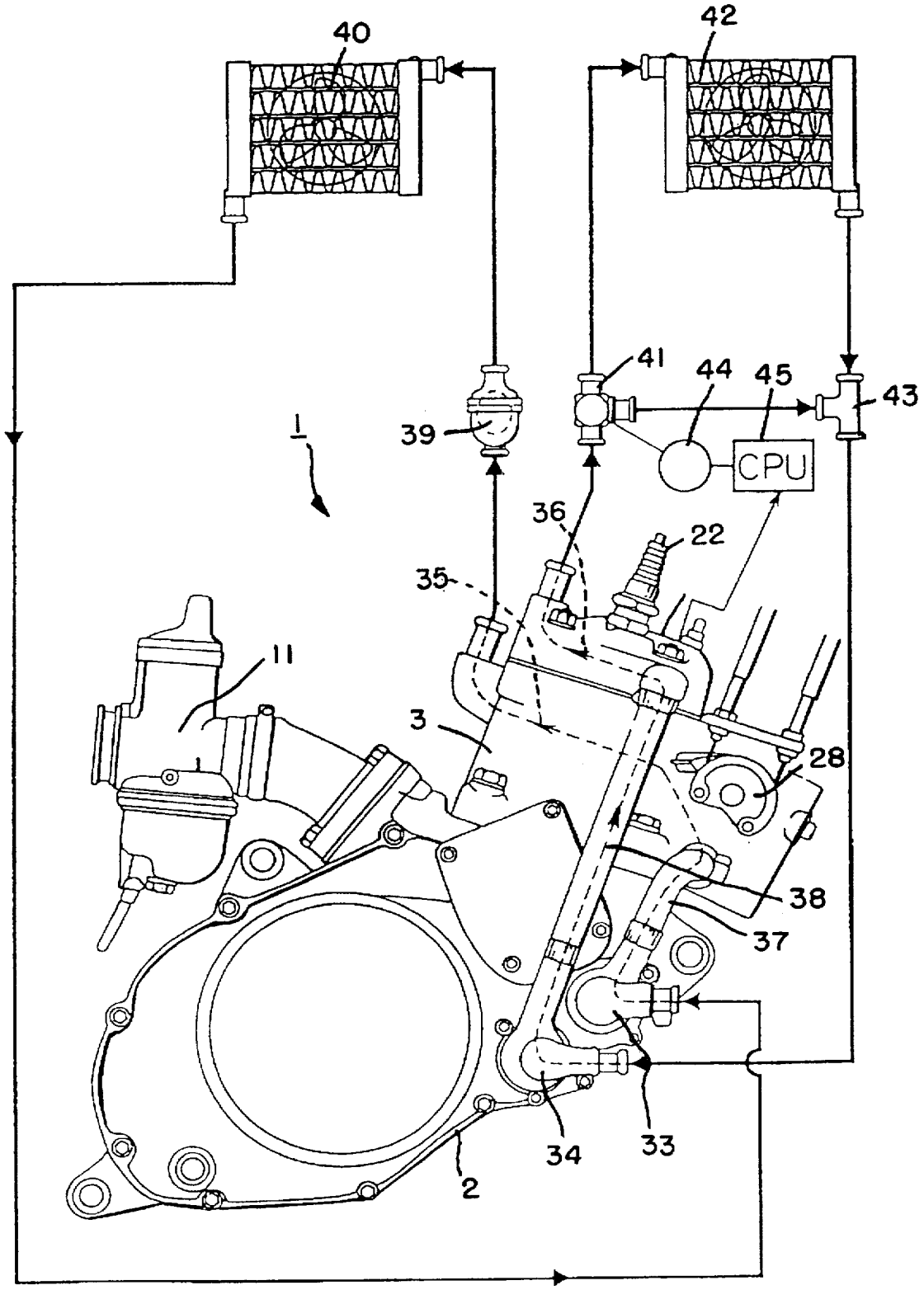

As shown in FIG. 4, the spark-ignition two-cycle engine 1 is provided with cooling water pumps 33 and 34, which are driven by the crank 8.

The inlet end of a cylinder cooling water passage 35 is connected to the discharge port of the cooling water pump 33 by a cooling water pipe 37. The inlet end of a cylinder head cooling water passage 36 is connected to the discharge port of the cooling water pump 34 by a cooling water pipe 38. The outlet end of the cylinder cooling water passage 35 is connected through a thermostat 39 to the upper end of a cylinder cooling radiator 40, and the lower end of the cylinder cooling radiator 40 is connected to the suction port of the cooling water pump 33.

The outlet end of the cylinder head cooling water passage 36 is connected through a three-way valve 41 to the upper end of a cylinder head cooling radiator 42, and the lower end of the cylinder head cooling radiator 42 is connected through a pipe fitting 43 to the suction port of the cooling water pump 34. The cylinder head cooling system is operated at a lower cooling capacity than that of the cylinder cooling system when the engine is in a cold condition such as at the start of the engine. Upon the rise of the temperature of the cylinder head cooling water beyond a predetermined temperature, a CPU 45 provides a control signal to operate a servomotor 44 so that the three-way valve 41 is changed from a position which connects the cylinder head cooling water passage 36 to the pipe fitting 43 into a position to connect the cylinder head cooling water passage 36 to the cylinder head cooling radiator 42 and to disconnect the cylinder head cooling water passage 36 from the pipe fitting 43.

Figure 5:
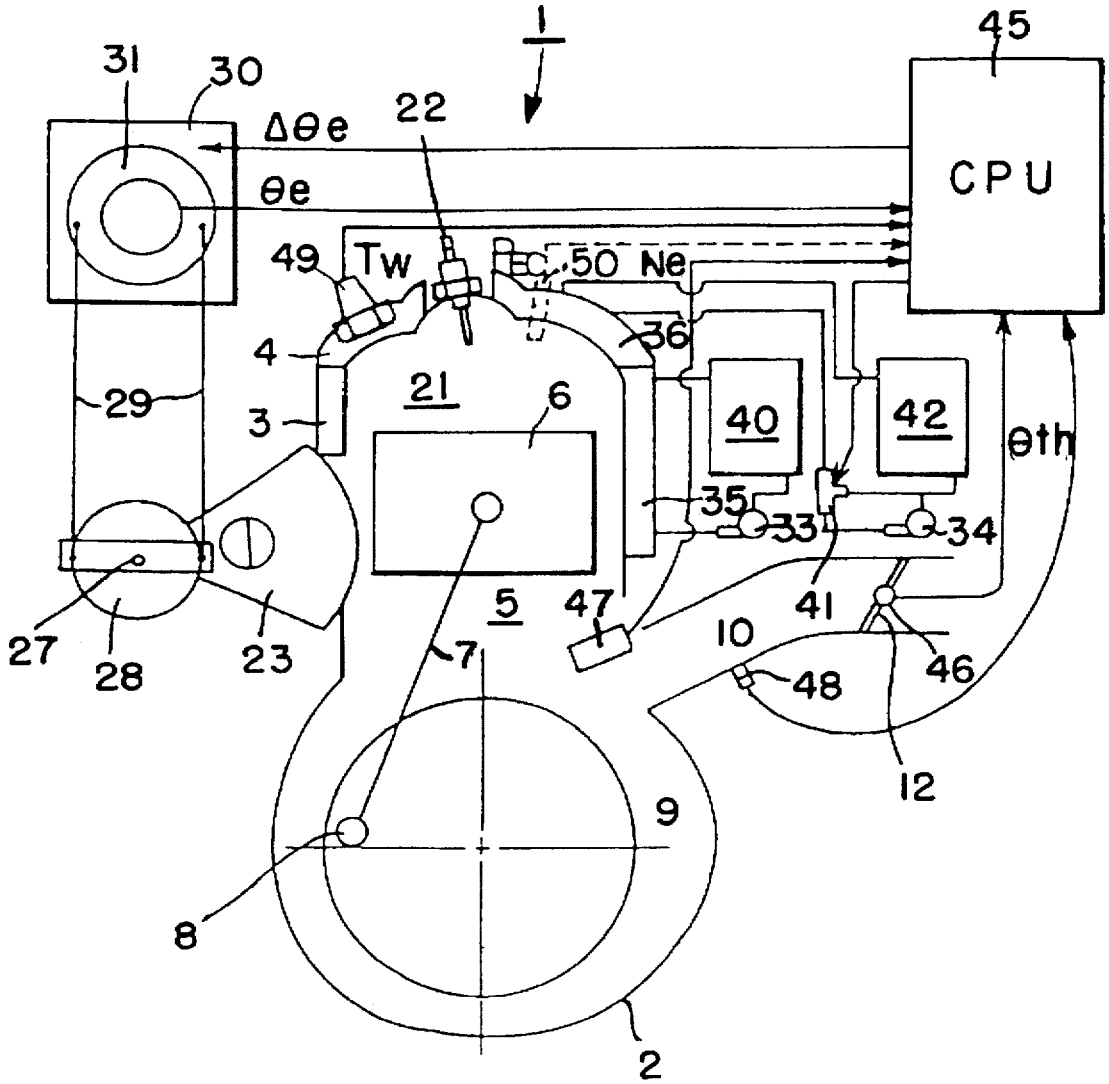
FIG. 5 is a schematic side view of the cooling system in the first embodiment.

Referring to FIG. 5 typically showing an essential portion of the spark-ignition two-cycle engine 1, the valve opening θth of the manually operated restrictor valve 12 is detected by a restrictor valve opening detector 46, such as a potentiometer, and a signal representing the valve opening θth is given to the CPU 45.

The CPU 45 also receives signals representing an engine speed Ne detected by an engine speed detector 47, an intake pressure $P_i$ detected by an intake pressure sensor 48, a cooling water temperature $T_w$ measured by a thermometer 49, an indicator pressure, a maximum indicator pressure generating time or ignition time detected by an optical sensor 50 or a compression starting pressure $P_{EC}$, the condition of the clutch, and the speed of the transmission.

Figure 6:
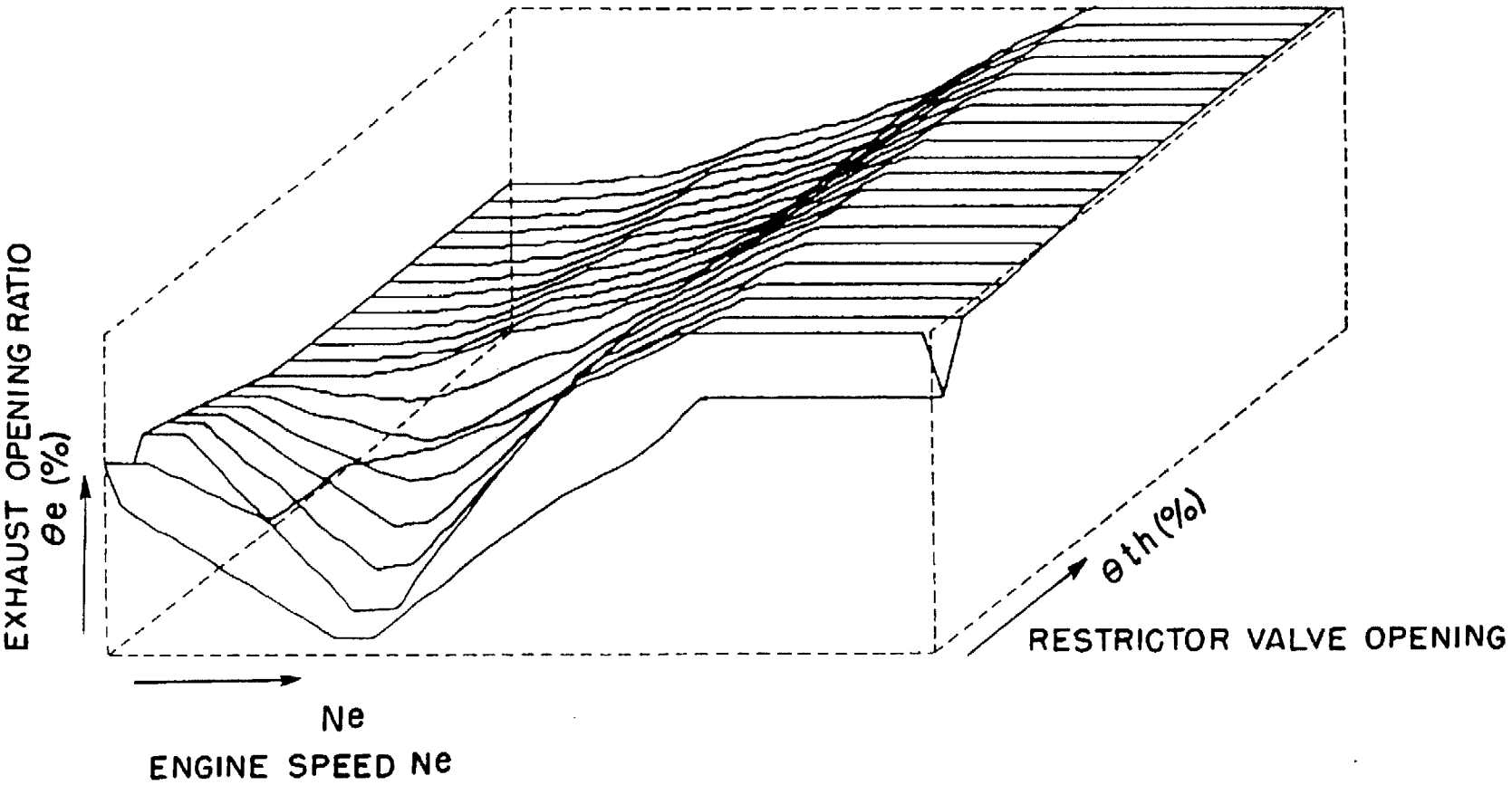
FIG. 6 is a view of a control map according to the principles of the present invention.

The CPU 45 judges the operating condition of the spark-ignition two-cycle engine 1 from those input signals and provides control signals. In an operation mode for AR combustion, the CPU 45 operates on the basis of a control map shown in FIG. 6 specifying exhaust opening ratio $\theta_e$ according to engine speed Ne and restrictor valve opening θth and sends a driving signal $\Delta\theta_e$ to select an exhaust opening ratio $\theta_e$ specified in the control map to the servomotor 30.

In the cooling system shown in FIGS. 1 to 5 as described, a port of the three-way valve 41 connected to the pipe fitting 43 is opened to return the cooling water to the suction port of the cooling water pump 34 without passing the cooling water through the cylinder head cooling radiator 42. Therefore, the cooling water flowing through the cylinder head cooling water passage 36 is not cooled in the cylinder head cooling radiator 42 and hence the wall of the combustion chamber 21 is not cooled excessively. Consequently, the combustion chamber 21 can be quickly heated to a temperature at which AR combustion is possible.

Upon the increase of the temperature of the cooling water flowing through the cylinder head cooling water passage 36 to the predetermined temperature, the port of the three-way valve 41 connected to the pipe fitting 43 is closed and a port of the three-way valve 41 connected to the cylinder head cooling radiator 42 is opened to allow the cooling water flowing through the cylinder head cooling water passage 36 to flow into the cylinder head cooling radiator 42. Consequently, the cooling water cooled properly in the cylinder head cooling radiator 42 is returned into the cylinder head cooling water passage 36 by the cooling water pump 34 to keep the temperature of the combustion chamber 21 in an appropriate temperature range, so that the spark-ignition two-cycle engine 1 is able to continue operation in a normal combustion mode or the AR combustion mode.

Figure 7:
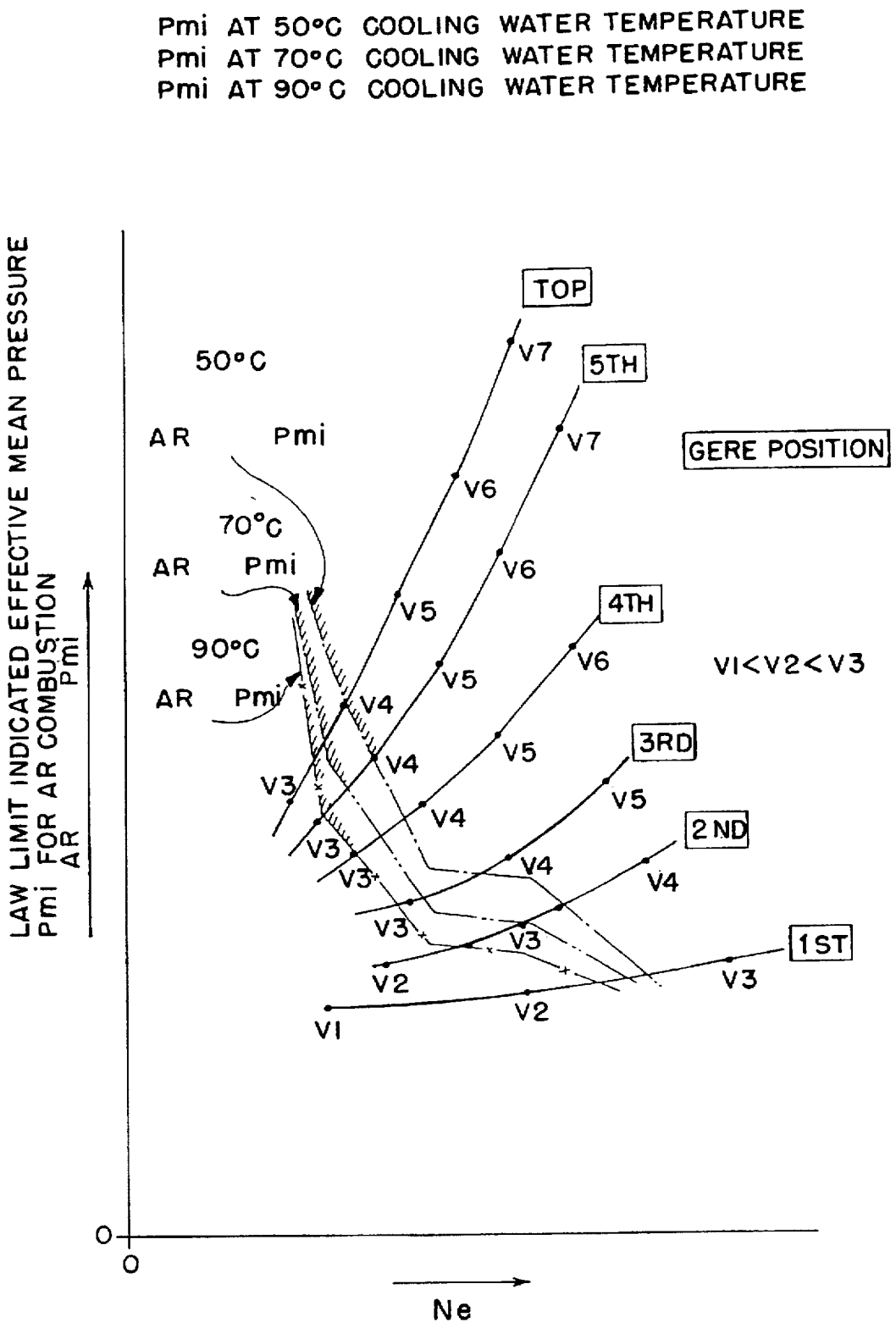
FIG. 7 is a graph showing the variation of the limit of indicated effective mean pressure that enables AR combustion with engine speed and traveling speed for different cooling water temperatures.

Referring to FIG. 7, as the temperature of the cooling water flowing through the cylinder head cooling water passage 36 rises from, for example, 50° C. toward 90° C., the indicated average effective pressure suitable for AR combustion decreases and the lower limit traveling speed decreases as well. Accordingly, AR combustion is possible even if the traveling speed further decreases, the discharge of unburnt hydrocarbons can be suppressed and the fuel consumption can be improved.

Figure 8:
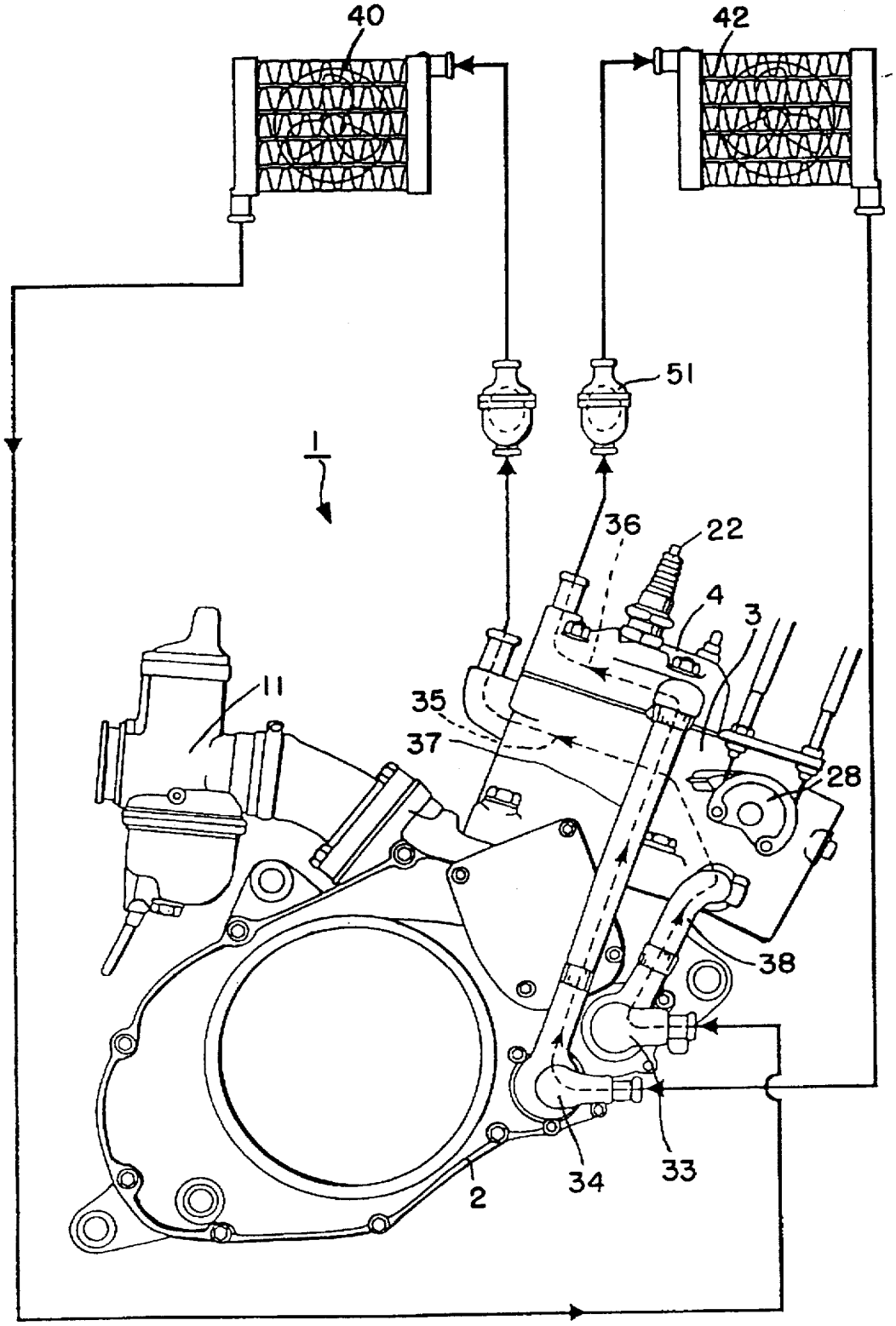
FIG. 8 is a side view of a spark-ignition two-cycle engine provided with a cooling system in a second embodiment according to the present invention.

Although the embodiment shown in FIGS. 1 to 5 is provided with the three-way valve 41 provided on the line connecting the cylinder head cooling water passage 36 to the cylinder head cooling radiator 42, in another embodiment, it is also possible to connect the cylinder head cooling water passage 36 through a thermostat 51 to the cylinder head cooling radiator 42 as shown in FIG. 8. In FIG. 8, the three-way valve 41 and the bypass line connecting the three-way valve 41 to the pipe fitting 43 are omitted. Although the embodiment shown in FIG. 8 is unable to raise the temperature of the cooling water flowing through the cylinder head cooling water passage 36 as quickly as the embodiment shown in FIGS. 1 to 5, the restrictive effect of the thermostat 51 and the resistance against the flow of the cooling water higher than that of the cylinder cooling water passage 35 make the temperature of the cooling water flowing through the cylinder head cooling water passage 36 rise at a rate higher than that at which the temperature of the cooling water flowing through the cylinder cooling water passage 35 to raise the temperature of the wall of the combustion chamber as quickly as possible to a temperature at which AR combustion is possible.

Figure 9:
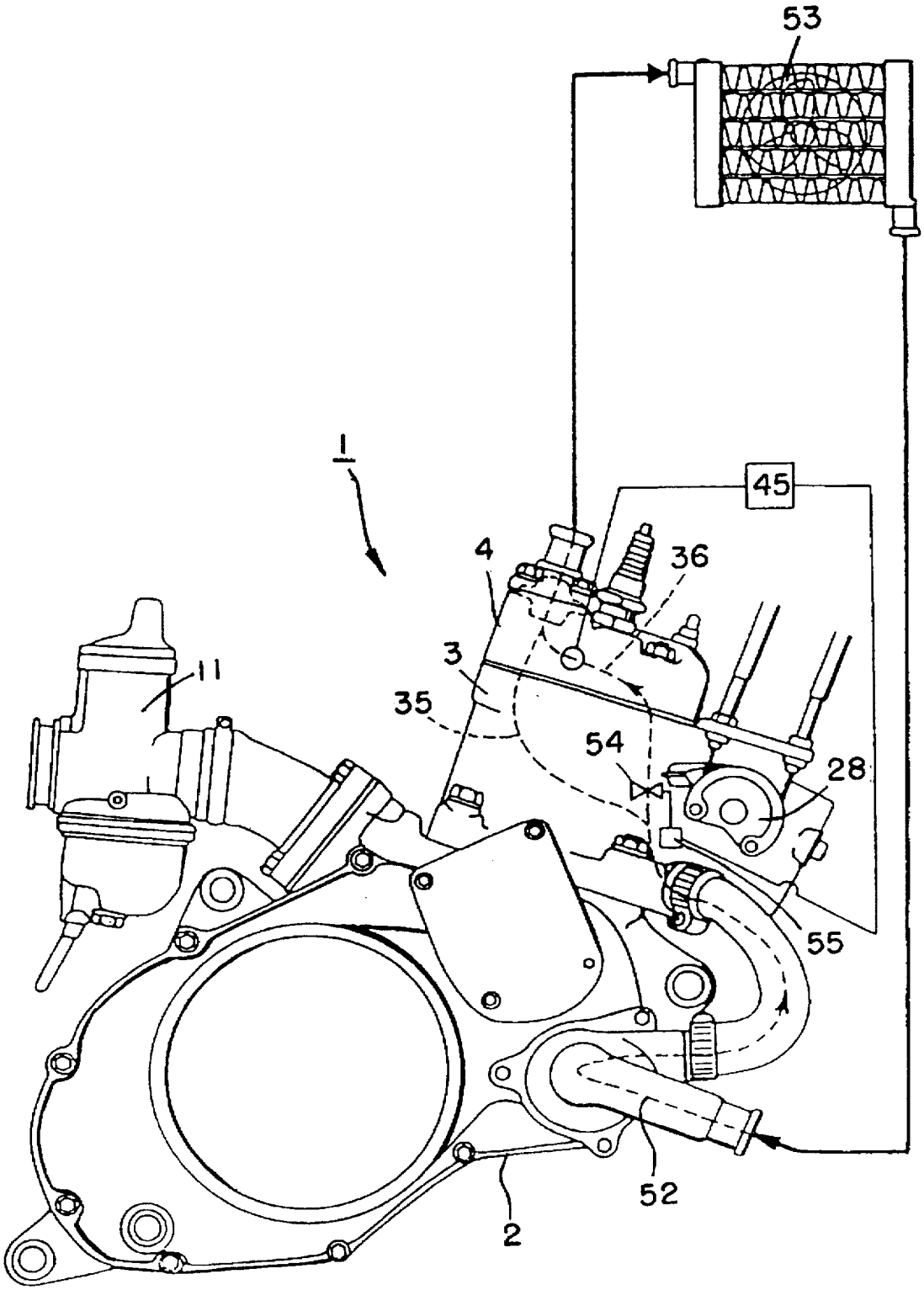
FIG. 9 is a side view of a spark-ignition two-cycle engine provided with a cooling system in a third embodiment according to the present invention.
Figure 10:
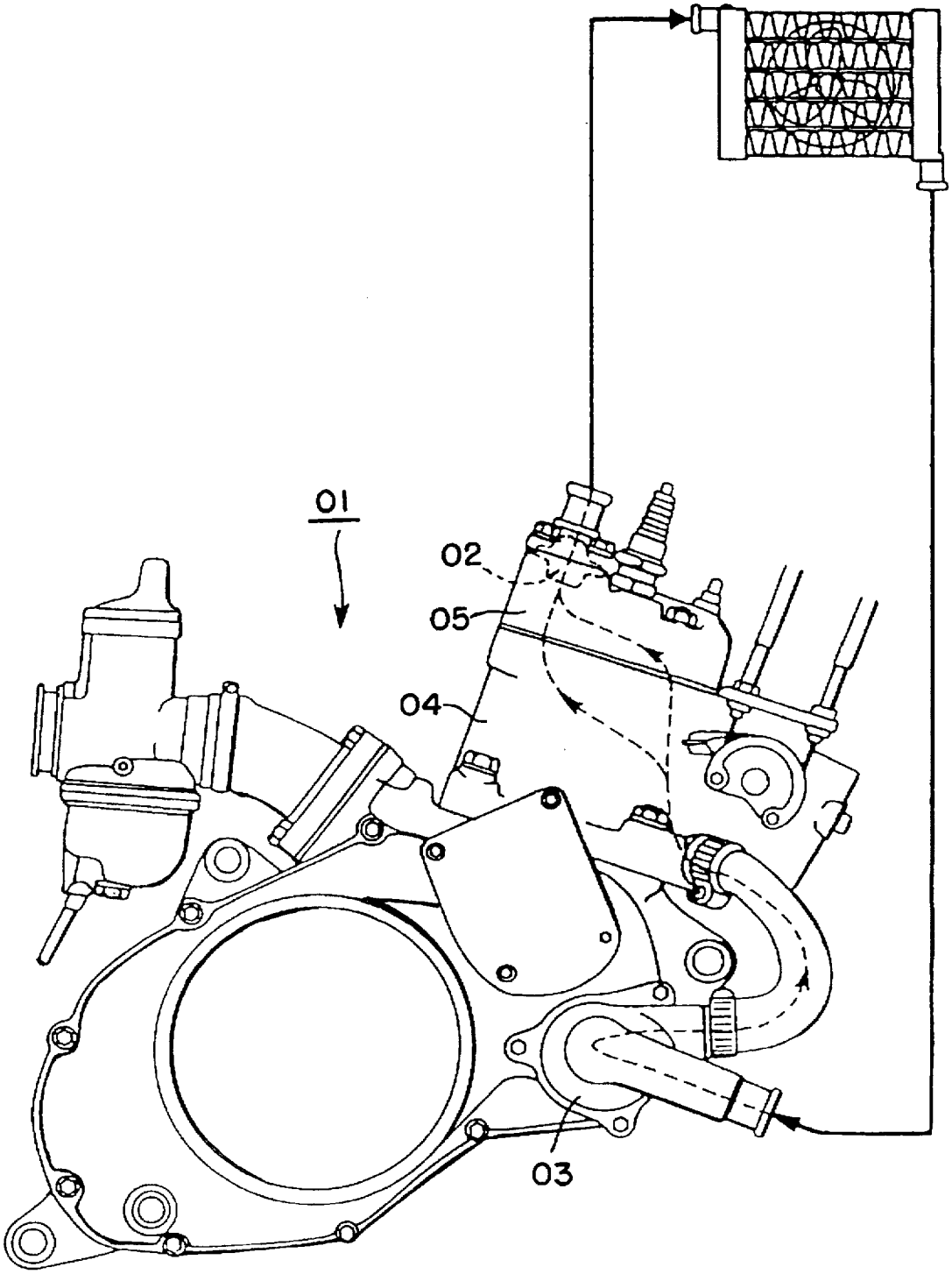
FIG.10 PRIOR ART
FIG. 10 is a side view of a conventional water-cooled two-cycle engine.

It is also possible, as shown in FIG. 9, to form the cylinder cooling water passage 35 and the cylinder head cooling water passage 36 in a parallel combination. In this arrangement, the cooling water flowing through the cylinder cooling water passage 35 and the cylinder head cooling water passage 36 flow through a single radiator 53 by a single cooling water pump 52 while the temperature of the cooling water is high. A shut-off valve 54 provided in the cylinder head cooling water passage 36 is closed by an actuator 55 operated by a control signal provided by the CPU 45, which receives a temperature signal from the cylinder head 4, to raise the temperature of the cooling water in the cylinder head cooling water passage 36 quickly while the temperature of the cooling water is low.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cooling system for a spark-ignition two-cycle engine that causes a fresh charge, charged into its combustion chamber, to self-ignite at least in a low-load operation mode, said cooling system comprising:

a cylinder cooling system;

a cylinder head cooling system combined in parallel with the cylinder cooling system operating said cylinder head cooling system at a cooling capacity lower than that of the cylinder cooling system when the engine is in a cold condition, and for and a cooling fluid temperature regulating means responsive to a plurality of different operating conditions of the spark-ignition two-cycle engine for increasing a cooling capacity of the cylinder head cooling system after a temperature of the cooling fluid circulating through the cylinder head cooling system has reached a predetermined temperature.

2. The cooling system according to claim 1, wherein said cylinder head cooling system includes a cylinder head fluid cooling passage, a three-way valve and a cylinder head cooling radiator connectable in series, whereby said three-way valve can be operated by said cooling fluid temperature regulating means to cause cooling fluid in said cylinder head cooling system to either bypass said cylinder head cooling radiator or to deliver said cooling fluid to said cylinder head cooling radiator.

3. The cooling system according to claim 2, wherein said cooling fluid temperature regulating means includes a CPU and a servomotor for opening and closing said three-way valve.

4. The cooling system according to claim 3, wherein the CPU is responsive to signals indicating a valve opening in the two-cycle engine.

5. The cooling system according to claim 3, wherein the CPU is responsive to speed and an intake pressure of the two-cycle engine.

6. The cooling system according to claim 1, wherein said cylinder head cooling system includes a first cooling fluid pump, a cylinder head fluid cooling passage, a three-way valve and a cylinder head cooling radiator connectable in series, whereby said three-way valve can be operated by said cooling fluid temperature regulating means to cause cooling fluid in said cylinder head cooling system to either bypass said cylinder head cooling radiator or to deliver said cooling fluid to said cylinder head cooling radiator.

7. The cooling system according to claim 6, wherein said cylinder cooling system includes a second cooling fluid pump, a cylinder cooling radiator and a cylinder cooling fluid passage connected in series.

8. The cooling system according to claim 6, wherein said cooling water temperature regulating means includes a CPU and a servomotor for opening or closing said three-way valve.

9. The cooling system according to claim 2, wherein said cylinder cooling system includes a cylinder cooling radiator and a cylinder cooling fluid passage connected in series.

10. A cooling system for a spark-ignition two-cycle engine that causes a fresh charge, charged into its combustion chamber, to self-ignite at least in a low-load operation mode, said cooling system comprising:

solely two radiators for cooling;

a cylinder cooling system including a cylinder fluid passage, a thermostat connected in series with one of said radiators; and a cylinder head cooling system, including a cylinder head fluid cooling passage, a thermostat connected in series with a second of said radiators, the cylinder cooling system and the cylinder head cooling system combined in parallel, with said cylinder head cooling system during a cold condition of the engine such as a cooling capacity lower than that of the cylinder cooling system during a cold condition of the two-cycle engine so that a fresh charge, charged into a combustion chamber of the spark-ignition two-cycle engine self-ignites in a low operational mode.

* * * * *